US009200808B2

(12) United States Patent
Romig et al.

(10) Patent No.: US 9,200,808 B2
(45) Date of Patent: Dec. 1, 2015

(54) SYSTEM FOR SUPPLYING FUEL TO A LATE-LEAN FUEL INJECTOR OF A COMBUSTOR

(75) Inventors: Bryan Wesley Romig, Simpsonville, SC (US); Lucas John Stoia, Taylors, SC (US); Patrick Benedict Melton, Horse Shoe, NC (US); Thomas Edward Johnson, Greer, SC (US); Gregory Allen Boardman, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 861 days.

(21) Appl. No.: 13/457,726

(22) Filed: Apr. 27, 2012

(65) Prior Publication Data

US 2013/0283801 A1 Oct. 31, 2013

(51) Int. Cl.

| | |
|---|---|
| ***F23R 3/28*** | (2006.01) |
| ***F23R 3/36*** | (2006.01) |
| ***F23R 3/34*** | (2006.01) |

(52) U.S. Cl.

CPC . *F23R 3/28* (2013.01); *F23R 3/346* (2013.01); *F23R 3/36* (2013.01)

(58) Field of Classification Search

CPC ..... F23R 3/28; F23R 3/36; F23R 3/346
See application file for complete search history.

(56) References Cited

U.S. PATENT DOCUMENTS

| | | | | |
|---|---|---|---|---|
| 3,901,445 | A * | 8/1975 | Chang | 239/132.3 |
| 3,934,409 | A * | 1/1976 | Quillevere et al. | 60/749 |
| 5,207,064 | A | 5/1993 | Ciokajlo et al. | |
| 5,235,813 | A * | 8/1993 | McVey et al. | 60/737 |
| 5,573,395 | A * | 11/1996 | Althaus et al. | 431/278 |
| 5,622,054 | A * | 4/1997 | Tingle | 60/737 |
| 5,749,219 | A * | 5/1998 | DuBell | 60/804 |
| 6,122,916 | A * | 9/2000 | Amos et al. | 60/747 |
| 6,148,604 | A * | 11/2000 | Salt et al. | 60/797 |
| 8,381,532 | B2 * | 2/2013 | Berry et al. | 60/795 |
| 2006/0156734 | A1 * | 7/2006 | Bland | 60/776 |
| 2007/0022758 | A1 * | 2/2007 | Myers et al. | 60/776 |
| 2007/0151250 | A1 * | 7/2007 | Haynes | 60/772 |
| 2007/0151251 | A1 * | 7/2007 | Haynes | 60/772 |

* cited by examiner

*Primary Examiner* — Phutthiwat Wongwian
*Assistant Examiner* — Carlos A Rivera
(74) *Attorney, Agent, or Firm* — Dority & Manning, PA

(57) ABSTRACT

A system for supplying fuel to a combustor includes a combustion chamber and a fuel nozzle that provides fluid communication into the combustion chamber. A plurality of passages circumferentially arranged around the combustion chamber provide fluid communication into the combustion chamber. A liquid fuel plenum provides fluid communication to the plurality of passages. A baffle circumferentially surrounds at least a portion of the liquid fuel plenum inside the plurality of passages and forms a plurality of lobes around the liquid fuel plenum.

17 Claims, 5 Drawing Sheets

SYSTEM FOR SUPPLYING FUEL TO A LATE-LEAN FUEL INJECTOR OF A COMBUSTOR

FIELD OF THE INVENTION

The present invention generally involves a system for supplying fuel to a combustor. In particular embodiments, one or more injectors circumferentially arranged around the combustor may supply a lean mixture of liquid fuel, gaseous fuel, and/or working fluid to the combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles where the compressed working fluid mixes with fuel and ignites in a combustion chamber to generate combustion gases having a high temperature and pressure. The combustion gases flow through a transition piece to the turbine and expand in the turbine to produce work. For example, expansion of the combustion gases in the turbine may rotate a shaft connected to a generator to produce electricity.

The combustion gases exiting the turbine include varying amounts of nitrogen oxides, carbon monoxide, unburned hydrocarbons, and other undesirable emissions, with the actual amount of each emission dependent on the combustor design and operating parameters. For example, a longer residence time of the fuel-air mixture in the combustion chamber generally increases the nitrogen oxide levels, while a shorter residence time of the fuel-air mixture in the combustion chamber generally increases the carbon monoxide and unburned hydrocarbon levels. Similarly, higher combustion gas temperatures associated with higher power operations generally increase the nitrogen oxide levels, while lower combustion gas temperatures associated with lower fuel-air mixtures and/or turndown operations generally increase the carbon monoxide and unburned hydrocarbon levels.

In a particular combustor design, one or more late lean injectors, passages, or tubes may be circumferentially arranged around the combustion chamber downstream from the fuel nozzles. A portion of the compressed working fluid exiting the compressor may be diverted to flow through the injectors to mix with fuel to produce a lean fuel-air mixture. The lean fuel-air mixture may then flow into the combustion chamber where it ignites to raise the combustion gas temperature and increase the thermodynamic efficiency of the combustor. Although the circumferentially arranged late lean injectors are effective at increasing combustion gas temperatures without producing a corresponding increase undesirable emissions, liquid fuel supplied to the late lean injectors often results in excessive coking in the fuel passages. In addition, the circumferential delivery of the lean fuel-air mixture into the combustion chamber may also result in liquid fuel streaming along the inside of the combustion chamber and transition piece, creating localized hot streaks that may reduce the low cycle fatigue limit for these components. As a result, a system for supplying liquid and/or gaseous fuel for late lean combustion without producing localized hot streaks along the inside of the combustion chamber and transition piece would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying fuel to a combustor that includes a combustion chamber and a fuel nozzle that provides fluid communication into the combustion chamber. A plurality of passages circumferentially arranged around the combustion chamber provide fluid communication into the combustion chamber. A liquid fuel plenum provides fluid communication to the plurality of passages. A baffle circumferentially surrounds at least a portion of the liquid fuel plenum inside the plurality of passages and forms a plurality of lobes around the liquid fuel plenum.

Another embodiment of the present invention is a system for supplying fuel to a combustor that includes a combustion chamber and a liner that circumferentially surrounds at least a portion of the combustion chamber. A plurality of passages extend through the liner and into the combustion chamber. A liquid fuel plenum extends inside each of the plurality of passages. A baffle circumferentially surrounds at least a portion of the liquid fuel plenum inside the plurality of passages and forms a plurality of lobes around the liquid fuel plenum.

In a still further embodiment, a system for supplying fuel to a combustor includes a combustion chamber and a liner that circumferentially surrounds at least a portion of the combustion chamber. A plurality of injectors circumferentially arranged around the combustion chamber provide fluid communication through the liner and into the combustion chamber. A liquid fuel plenum is centrally aligned inside at least some of the plurality of injectors. A baffle circumferentially surrounding at least a portion of the liquid fuel plenum inside the at least some of the plurality of injectors forms a plurality of lobes around the liquid fuel plenum.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
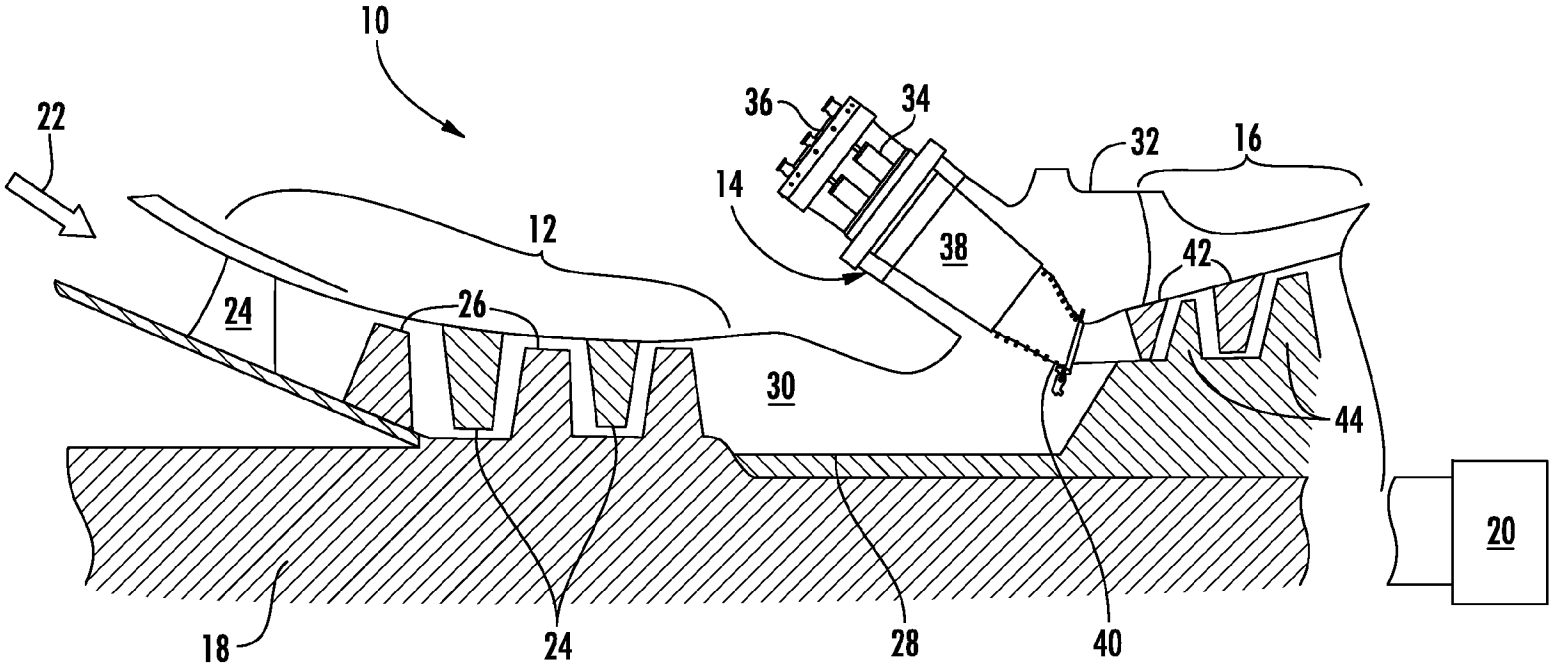
FIG. 1 is a simplified side cross-section view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system for supplying fuel to a combustor. The combustor generally includes a combustion chamber defined at least in part by a liner that circumferentially surrounds at least a portion of the combustion chamber. The system includes one or more passages or injectors circumferentially arranged around the combustion chamber to provide fluid communication into the combustion chamber, and a liquid fuel plenum provides fluid communication to the passages or injectors. In addition, a baffle circumferentially surrounds at least a portion of the liquid fuel plenum and forms a plurality of lobes around the liquid fuel plenum. In this manner, the baffle defines fluid flow passages inside and outside of the baffle, and the lobes mix the fluid flow between the passages to enhance liquid fuel atomization, vaporization, and/or mixing prior to injection into the combustion chamber. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section of an exemplary gas turbine 10 that may incorporate various embodiments of the present invention. As shown, the gas turbine 10 may generally include a compressor 12 at the front, one or more combustors 14 radially disposed around the middle, and a turbine 16 at the rear. The compressor 12 and the turbine 16 may share a common rotor 18 connected to a generator 20 to produce electricity.

The compressor 12 may be an axial flow compressor in which a working fluid 22, such as ambient air, enters the compressor 12 and passes through alternating stages of stationary vanes 24 and rotating blades 26. A compressor casing 28 contains the working fluid 22 as the stationary vanes 24 and rotating blades 26 accelerate and redirect the working fluid 22 to produce a continuous flow of compressed working fluid 22. The majority of the compressed working fluid 22 flows through a compressor discharge plenum 30 to the combustor 14.

The combustor 14 may be any type of combustor known in the art. For example, as shown in FIG. 1, a combustor casing 32 may circumferentially surround some or all of the combustor 14 to contain the compressed working fluid 22 flowing from the compressor 12. One or more fuel nozzles 34 may be radially arranged in an end cover 36 to supply fuel to a combustion chamber 38 downstream from the fuel nozzles 34. Possible fuels include, for example, one or more of blast furnace gas, coke oven gas, natural gas, vaporized liquefied natural gas (LNG), hydrogen, and propane. The compressed working fluid 22 may flow from the compressor discharge passage 30 along the outside of the combustion chamber 38 before reaching the end cover 36 and reversing direction to flow through the fuel nozzles 34 to mix with the fuel. The mixture of fuel and compressed working fluid 22 flows into the combustion chamber 38 where it ignites to generate combustion gases having a high temperature and pressure. The combustion gases flow through a transition piece 40 to the turbine 16.

The turbine 16 may include alternating stages of stators 42 and rotating buckets 44. The first stage of stators 42 redirects and focuses the combustion gases onto the first stage of turbine buckets 44. As the combustion gases pass over the first stage of turbine buckets 44, the combustion gases expand, causing the turbine buckets 44 and rotor 18 to rotate. The combustion gases then flow to the next stage of stators 42 which redirects the combustion gases to the next stage of rotating turbine buckets 44, and the process repeats for the following stages.

The various embodiments described herein include one or more injectors, passages, or tubes 50 circumferentially arranged around the combustion chamber 38 downstream from the fuel nozzles 34. A portion of the compressed working fluid 22 exiting the compressor 12 may be diverted to flow through the injectors 50 to mix with the same or a different liquid and/or gaseous fuel than is supplied to the fuel nozzles 34 to produce a lean fuel-air mixture. The lean fuel-air mixture may then flow into the combustion chamber 38 where it ignites to raise the combustion gas temperature and increase the thermodynamic efficiency of the combustor 14.

Figure 2:
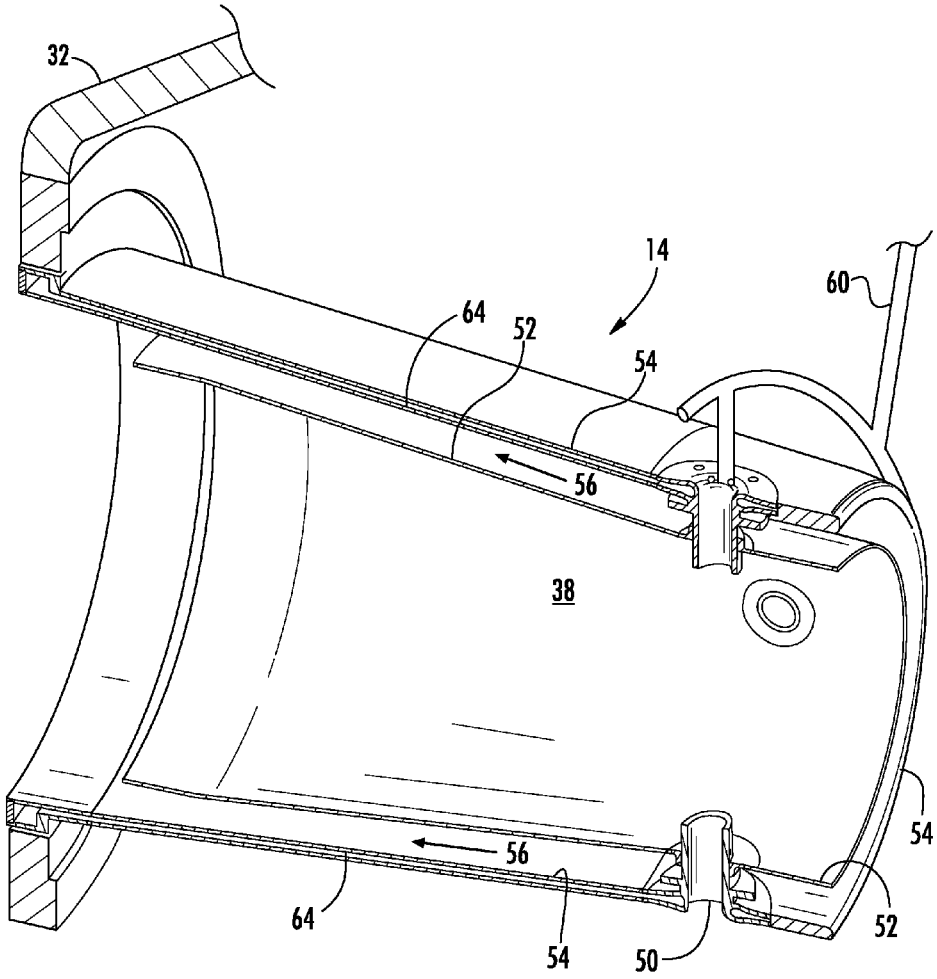
FIG. 2 is a partial perspective and side cross-section view of a portion of the combustion chamber shown in FIG. 1 according to a first embodiment of the present invention.

FIG. 2 provides a partial perspective and side cross-section view of a portion of the combustion chamber 38 shown in FIG. 1 according to a first embodiment of the present invention. In this particular embodiment, a liner 52 circumferentially surrounds at least a portion of the combustion chamber 38, and a flow sleeve 54 circumferentially surrounds at least a portion of the liner 52 to create an annular passage 56 between the liner 52 and the flow sleeve 54. In this manner, a portion of the compressed working fluid 22 may flow through the annular passage 56 to remove heat from the liner 52 before reaching the end cover 36 and reversing direction to flow through the fuel nozzles 34, as previously described with respect to FIG. 1.

As shown in FIG. 2, the injectors, passages, or tubes 50 are circumferentially arranged around the combustion chamber 38, liner 52, and flow sleeve 54 to provide fluid communication through the flow sleeve 54 and liner 52 into the combustion chamber 38. In addition, liquid and/or gaseous fuel may be supplied to the injectors 50 to mix with a portion of the compressed working fluid 22 that flows through the injectors 50 and into the combustion chamber 38. For example, a liquid fuel plenum 60 may circumferentially surround the combustion chamber 38, and a portion of the liquid fuel plenum 60 may extend inside one or more of the injectors 50 to provide fluid communication for liquid fuel to flow into the injectors 50. The liquid fuel plenum 60 may include one or more liquid fuel ports 62 that provide fluid communication for the liquid fuel to flow into the injectors 50 and mix with the compressed working fluid 22 before reaching the combustion chamber 38. Alternately, or in addition, the flow sleeve 54 may include an internal fuel passage 64, and each injector 50 may include one or more gaseous fuel ports 66 circumferentially arranged around the injector 50. The gaseous fuel ports 66 may thus provide fluid communication for the gaseous fuel to flow into the injectors 50 and mix with the compressed working fluid 22 before reaching the combustion chamber 38. In this manner, the injectors 50 may supply a lean mixture of liquid and/or gaseous fuel for additional combustion to raise the temperature, and thus the efficiency, of the combustor 14.

Figure 3:
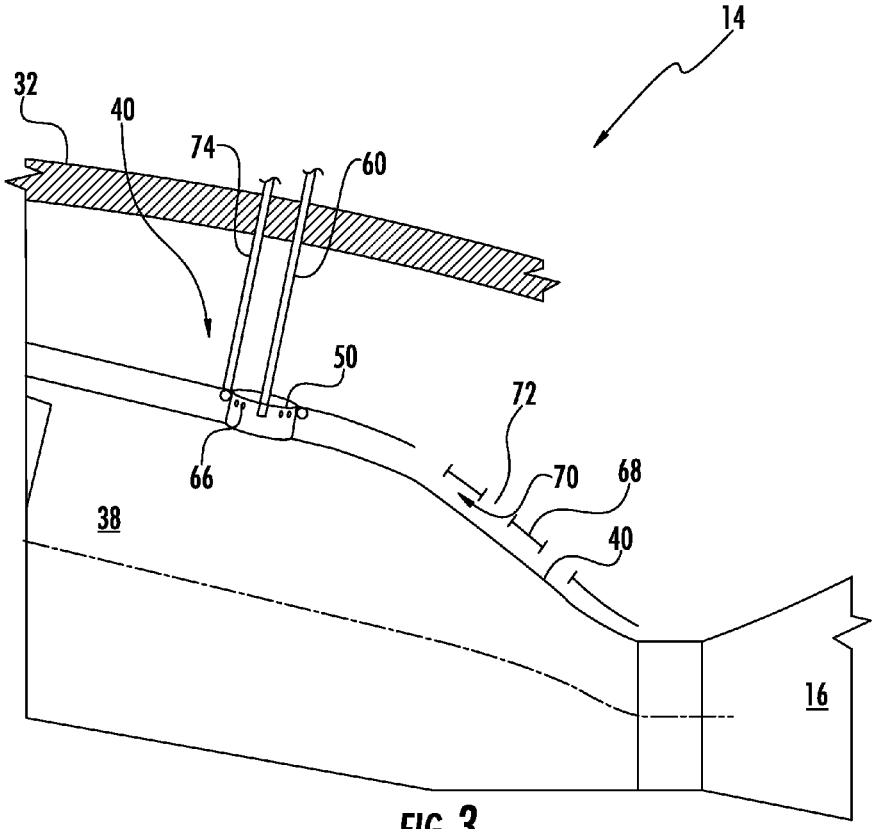
FIG. 3 is a side cross-section view of a portion of the combustion chamber shown in FIG. 1 according to a second embodiment of the present invention.

FIG. 3 provides a side cross-section view of a portion of the combustion chamber 38 shown in FIG. 1 according to a second embodiment of the present invention. In this particular embodiment, an impingement sleeve 68 circumferentially surrounds at least a portion of the transition piece 40 to create an annular passage 70 between the transition piece 40 and the impingement sleeve 68. The impingement sleeve 68 may include a plurality of apertures 72 that allow a portion of the compressed working fluid 22 to flow through the annular passage 70 to remove heat from the transition piece 40.

As shown in FIG. 3, the injectors, passages, or tubes 50 are circumferentially arranged around the combustion chamber 38, transition piece 40, and impingement sleeve 68 to provide fluid communication through the impingement sleeve 68 and transition piece 40 into the combustion chamber 38. In addition, the liquid fuel plenum 60 may extend through the casing 32 and inside one or more of the injectors 50 to provide fluid communication for liquid fuel to flow into the injectors 50. Alternately, or in addition, a gaseous fuel plenum 74 may similarly extend through the casing 32 to provide fluid communication for the gaseous fuel to flow through gaseous fuel ports 66 circumferentially arranged around the injectors 50, as previously described with respect to the embodiment shown in FIG. 2. In this manner, the liquid and/or gaseous fuel plenums 60, 74 may supply liquid and/or gaseous fuel through the injectors 50 and into the combustion chamber 38 for additional combustion.

Figure 4:
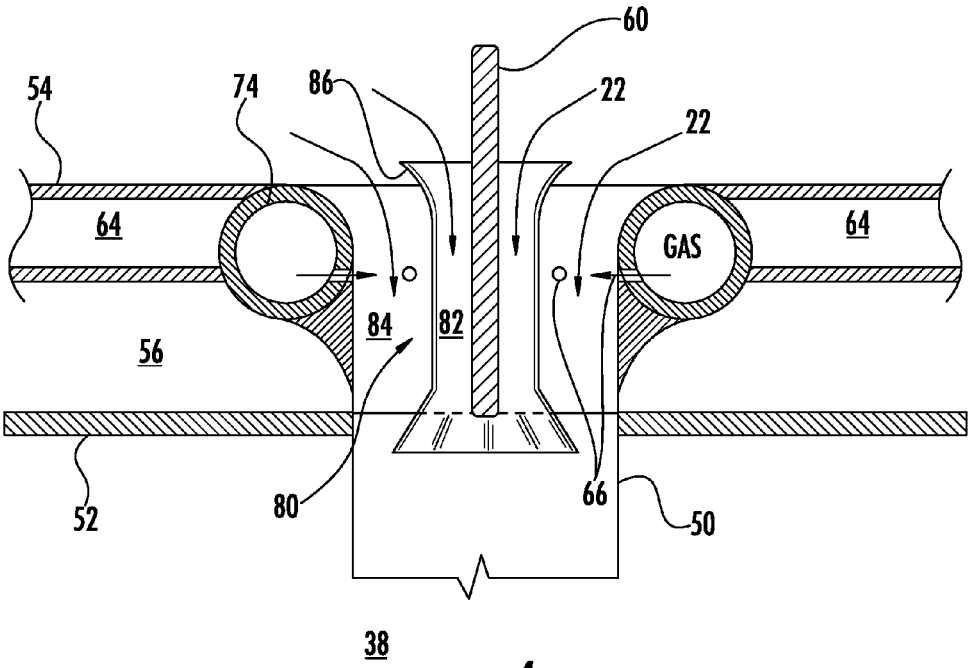
FIG. 4 is a side cross-section view of the injector shown in FIG. 2 according to a particular embodiment of the present invention.

FIG. 4 provides a side cross-section view of the injector 50 shown in FIG. 2 according to a particular embodiment of the present invention. As shown, the injector 50 may include a passage, tube, or other structure for providing fluid communication through the flow sleeve 54 and liner 52 and into the combustion chamber 38. In the particular embodiment shown in FIG. 4, a portion of the injector 50 extends inside the combustion chamber 38 to enhance mixing between the liquid and/or gaseous fuel and the compressed working fluid 22 before mixing with the combustion gases flowing through the combustion chamber 38.

As previously described, the liquid fuel plenum 60 may extend at least partially inside the injector 50, and the gaseous fuel ports 66 circumferentially arranged around the injector 50 may provide fluid communication for the gaseous fuel to flow from the internal fuel passage 64 in the flow sleeve 54 into the injector 50. In addition, a baffle 80 connected to the injector 50, liner 52, and/or the liquid fuel plenum 60 may circumferentially surround at least a portion of the liquid fuel plenum 60 inside the injector 50. The baffle 80 may define a first fluid passage 82 between the liquid fuel plenum 60 and the baffle 80 and a second fluid passage 84 between the baffle 80 and the injector 50. In particular embodiments, the baffle 80 may include a flared or bellmouth opening 86 at the inlet to the injector 50 as shown in FIG. 4 to preferentially divert more of the compressed working fluid 22 into the first fluid passage 82.

Figure 5:
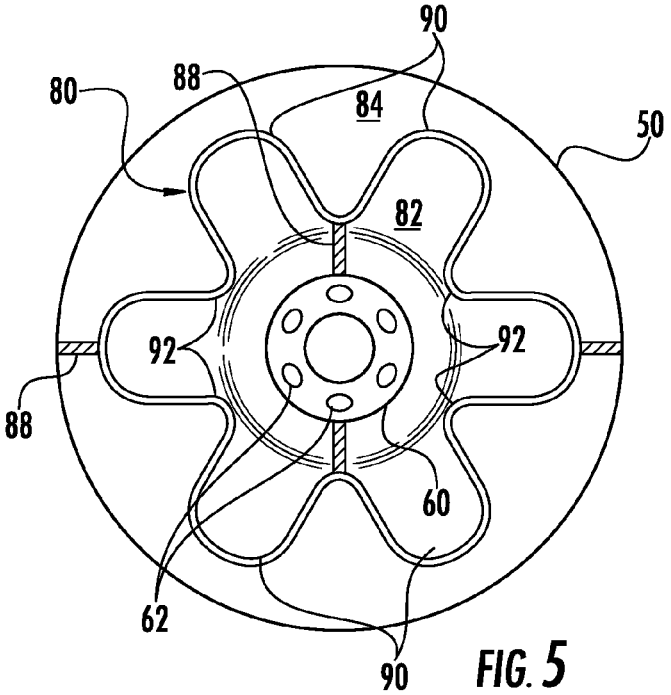
FIG. 5 is a radial plan view of the injector shown in FIG. 4.
Figure 6:
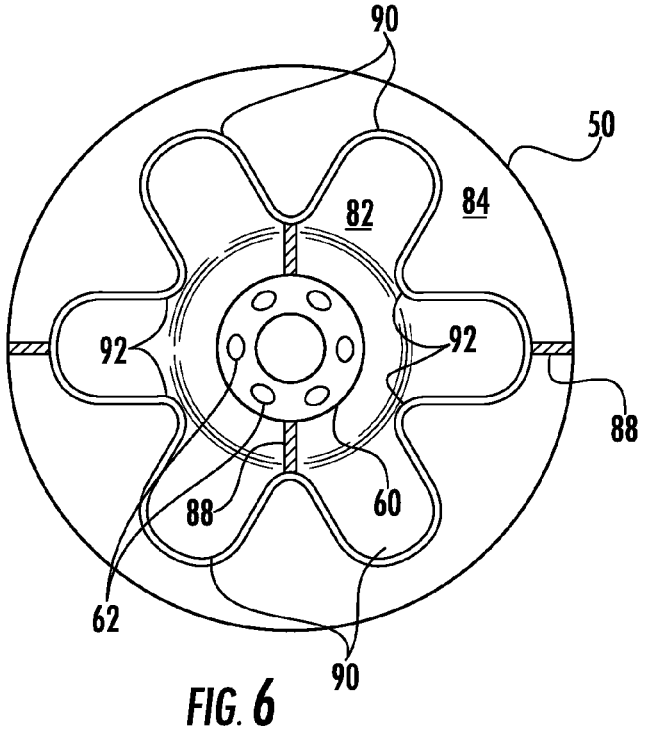
FIG. 6 is a radial plan view of the injector shown in FIG. 4 according to an alternate embodiment.

FIGS. 5 and 6 provide radial plan views of the injector 50 shown in FIG. 4 as seen from inside the combustion chamber 38 to more clearly illustrate particular features of the baffle 80 according to various embodiments of the present invention. As shown in FIGS. 5 and 6, one or more struts 88 may extend between the baffle 80 and the injector 50, liner 52, and/or liquid fuel plenum 60 to hold the baffle 80 in place. A portion of the compressed working fluid 22 may flow through the first fluid passage 82 between the liquid fuel plenum 60 and the baffle 80 to mix with the liquid fuel flowing out of the liquid fuel ports 62. Another portion of the compressed working fluid 22 may also flow through the second fluid passage 84 between the baffle 80 and the injector 50 to mix with the gaseous fuel flowing out of the gaseous fuel ports 66.

As seen most clearly in FIGS. 5 and 6, the downstream portion of the baffle 80 may include alternating lobes 90 and vertices 92 circumferentially surrounding the liquid fuel plenum 60 and the liquid fuel ports 62. In the particular embodiment shown in FIG. 5, the liquid fuel ports 62 are radially aligned coincident with the vertices 92 and between adjacent lobes 90. In contrast, in FIG. 6 the liquid fuel ports 62 are radially aligned coincident with the lobes 90 and between adjacent vertices 92. The alternating lobes 90 and vertices 92 in the baffle 80 push fluid flow through the first fluid passage 82 radially outward while drawing fluid flow through the second fluid passage 84 radially inward. As a result, the lobes 90 and vertices 92 in the baffle 80 create shear between the fluid flowing through the first and second fluid passages 82, 84 to enhance evaporation, atomization, and/or mixing of the liquid fuel with the gaseous fuel and/or compressed working fluid 22.

One of ordinary skill in the art will readily appreciate from the teachings herein that the various embodiments shown and described with respect to FIGS. 1-6 may provide one or more benefits over existing combustor designs. For example, the lean fuel-air mixture supplied to the combustion chamber 38 may increase the combustion gas temperature to enhance combustor 14 efficiency without producing a corresponding increase in $NO_X$ emissions. In addition, the various embodiments described herein enable liquid fuel to be supplied through the injectors 50 without creating localized hot streaks along the inside of the combustion chamber 38 and transition piece 40 that may reduce the low cycle fatigue limit for these components.

This written description uses examples to disclose the invention, including the best mode, and also to enable any person skilled in the art to practice the invention, including making and using any devices or combustors and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supplying fuel to a combustor, comprising:

a. a combustion chamber;

b. a fuel nozzle that provides fluid communication into the combustion chamber;

c. a plurality of passages circumferentially arranged surrounding the combustion chamber, wherein the plurality of passages provide fluid communication into the combustion chamber;

d. a liquid fuel plenum that provides fluid communication to the plurality of passages;

e. a baffle circumferentially surrounding at least a portion of the liquid fuel plenum inside the plurality of passages, wherein the baffle forms a plurality of lobes around the liquid fuel plenum and;

f. a plurality of gaseous fuel ports circumferentially surrounding the baffle inside the plurality of passages.

2. The system as in claim 1, wherein at least one of the plurality of passages extends inside the combustion chamber.

3. The system as in claim 1, wherein at least a portion of the liquid fuel plenum circumferentially surrounds the combustion chamber.

4. The system as in claim 1, further comprising a sleeve that circumferentially surrounds at least a portion of the combustion chamber and wherein the plurality of passages provide fluid communication through the sleeve.

5. The system as in claim 1, wherein the liquid fuel plenum terminates at a plurality of liquid fuel ports radially aligned between the plurality of lobes.

6. The system as in claim 1, wherein the baffle defines a first fluid passage between the liquid fuel plenum and the baffle and a second fluid passage between the baffle and the plurality of passages.

7. A system for supplying fuel to a combustor, comprising:

a. a combustion chamber;

b. a liner that circumferentially surrounds at least a portion of the combustion chamber;

c. a plurality of passages through the liner and into the combustion chamber;

d. a liquid fuel plenum that extends inside each of the plurality of passages;

e. a baffle circumferentially surrounding at least a portion of the liquid fuel plenum inside the plurality of passages, wherein the baffle forms a plurality of lobes around the liquid fuel plenum and;

f. a plurality of gaseous fuel ports circumferentially arranged around the baffle inside the plurality of passages.

8. The system as in claim 7, wherein at least one of the plurality of passages extends inside the combustion chamber.

9. The system as in claim 7, further comprising a sleeve that circumferentially surrounds at least a portion of the combustion chamber and wherein the plurality of passages provide fluid communication through the sleeve.

10. The system as in claim 7, wherein the liquid fuel plenum terminates at a plurality of liquid fuel ports radially aligned with the plurality of lobes.

11. The system as in claim 7, wherein the liquid fuel plenum terminates at a plurality of liquid fuel ports radially aligned between the plurality of lobes.

12. The system as in claim 7, wherein the baffle defines a first fluid passage between the liquid fuel plenum and the baffle and a second fluid passage between the baffle and the plurality of passages.

13. A system for supplying fuel to a combustor, comprising:

a. a combustion chamber;

b. a liner that circumferentially surrounds at least a portion of the combustion chamber;

c. a plurality of injectors circumferentially arranged around the combustion chamber, wherein the plurality of injectors provide fluid communication through the liner and into the combustion chamber;

d. a liquid fuel plenum centrally aligned inside at least some of the plurality of injectors;

e. a baffle circumferentially surrounding at least a portion of the liquid fuel plenum inside the at least some of the plurality of injectors, wherein the baffle forms a plurality of lobes around the liquid fuel plenum; and f. a plurality of gaseous fuel ports circumferentially arranged around the baffle inside the plurality of passages.

14. The system as in claim 13, wherein the baffle is connected to at least one of the liner or the liquid fuel plenum.

15. The system as in claim 13, wherein the liquid fuel plenum terminates at a plurality of liquid fuel ports radially aligned with the plurality of lobes.

16. The system as in claim 13, wherein the liquid fuel plenum terminates at a plurality of liquid fuel ports radially aligned between the plurality of lobes.

17. The system as in claim 13, wherein the baffle defines a first fluid passage between the liquid fuel plenum and the baffle and a second fluid passage between the baffle and the plurality of passages.

* * * * *